US008176699B1

(12) United States Patent
Birchfield

(10) Patent No.: US 8,176,699 B1
(45) Date of Patent: May 15, 2012

(54) HURRICANE TRUSS ROOF SYSTEM

(76) Inventor: Robert J. Birchfield, Nokomis, FL (US)

( * ) Notice: Subject to any disclaimer, the term of this patent is extended or adjusted under 35 U.S.C. 154(b) by 3 days.

(21) Appl. No.: 12/799,827

(22) Filed: May 3, 2010

(51) Int. Cl.
*E04B 1/74* (2006.01)

(52) U.S. Cl. ..... 52/407.3; 52/406.2; 52/410; 52/639; 52/693; 52/843

(58) Field of Classification Search ..... 52/90.1, 52/93.1, 406.1–406.3, 407.1–407.5, 410, 52/639, 690, 693–696, 843, 845
See application file for complete search history.

(56) References Cited

U.S. PATENT DOCUMENTS

| | | | | | |
|---|---|---|---|---|---|
| 1,382,199 | A * | 6/1921 | Lachman | 52/634 |
| 1,643,577 | A * | 9/1927 | Dornier | 52/843 |
| 1,743,327 | A * | 1/1930 | Dornier | 52/634 |
| 2,007,898 | A * | 7/1935 | Ragsdale | 52/692 |
| 2,514,607 | A * | 7/1950 | Mclean | 52/692 |
| 2,626,024 | A * | 1/1953 | Persson | 52/658 |
| 2,777,786 | A * | 1/1957 | Schwartz et al. | 52/406.3 |
| 2,782,914 | A * | 2/1957 | Giles | 428/101 |
| 3,019,861 | A * | 2/1962 | Rasch et al. | 52/639 |
| 3,092,222 | A * | 6/1963 | Heinle | 138/116 |
| 4,201,021 | A * | 5/1980 | Aldag et al. | 52/93.1 |
| 4,275,541 | A * | 6/1981 | Orals et al. | 52/481.1 |
| 4,575,974 | A * | 3/1986 | Porter | 52/86 |
| 4,704,312 | A * | 11/1987 | Butcher | 428/12 |
| 4,970,833 | A * | 11/1990 | Porter | 52/93.1 |
| 5,483,782 | A * | 1/1996 | Hall | 52/836 |
| 5,625,996 | A * | 5/1997 | Bechtel | 52/843 |
| 5,921,053 | A * | 7/1999 | Callahan et al. | 52/843 |
| 6,047,513 | A * | 4/2000 | Gibson | 52/646 |
| 6,094,881 | A * | 8/2000 | Lockwood | 52/845 |
| 6,857,238 | B2 * | 2/2005 | Alderman | 52/407.3 |
| 7,818,922 | B2 * | 10/2010 | Ellis | 52/95 |
| 7,832,153 | B2 * | 11/2010 | Crookston | 52/127.5 |
| 2003/0126827 | A1 * | 7/2003 | Davis | 52/731.2 |
| 2005/0279049 | A1 * | 12/2005 | MacKenzie et al. | 52/730.4 |
| 2006/0277859 | A1 * | 12/2006 | Egli et al. | 52/730.4 |
| 2009/0126302 | A1 * | 5/2009 | Thomas | 52/407.3 |

FOREIGN PATENT DOCUMENTS

WO WO 2005045148 A1 * 5/2005

* cited by examiner

*Primary Examiner* — Brian Glessner
*Assistant Examiner* — Adriana Figueroa

(57) ABSTRACT

Each of a plurality of vertically disposed trusses having angled rafters and a joint is coupled to a ridge board. Upper TboxTrusses function as the rafters. Each upper TboxTruss has a planar plate. The planar plate has a hollow box depending downwardly there from. An interior sheet of fire resistant fabric sheet material is above the upper TboxTrusses. An exterior sheet of the fire resistant fabric sheet material is below the upper TboxTrusses. Insulation material is located between the interior and exterior sheets and bounded by adjacent hollow boxes.

4 Claims, 4 Drawing Sheets

FIG 1
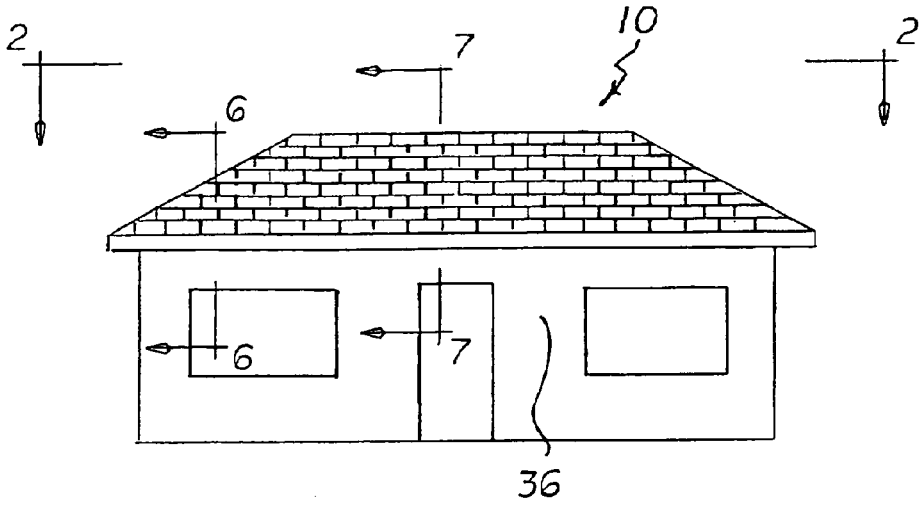
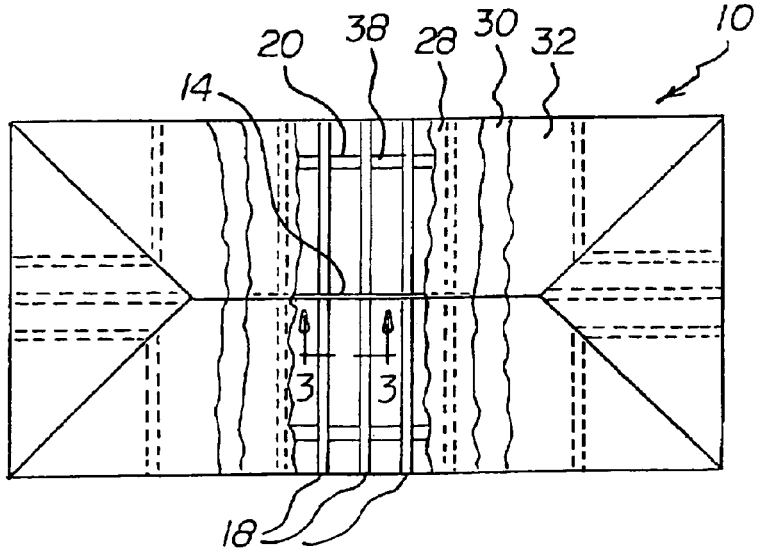
FIG 2

FIG 3
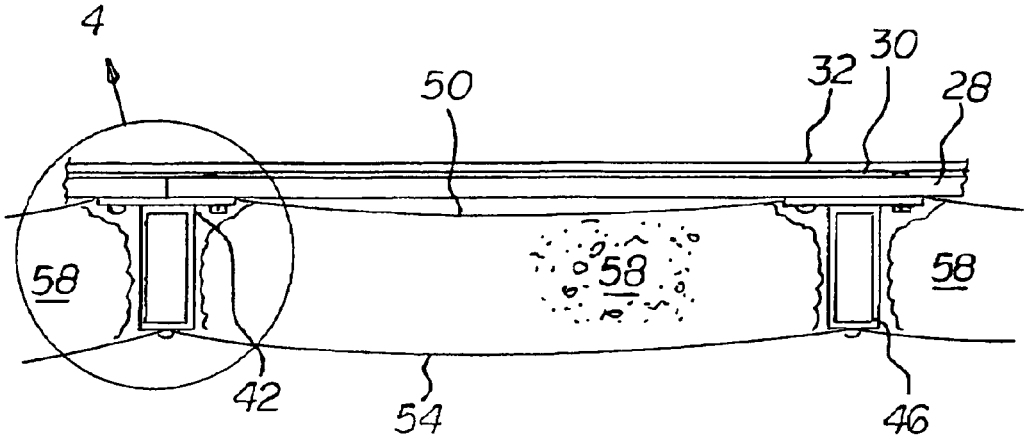
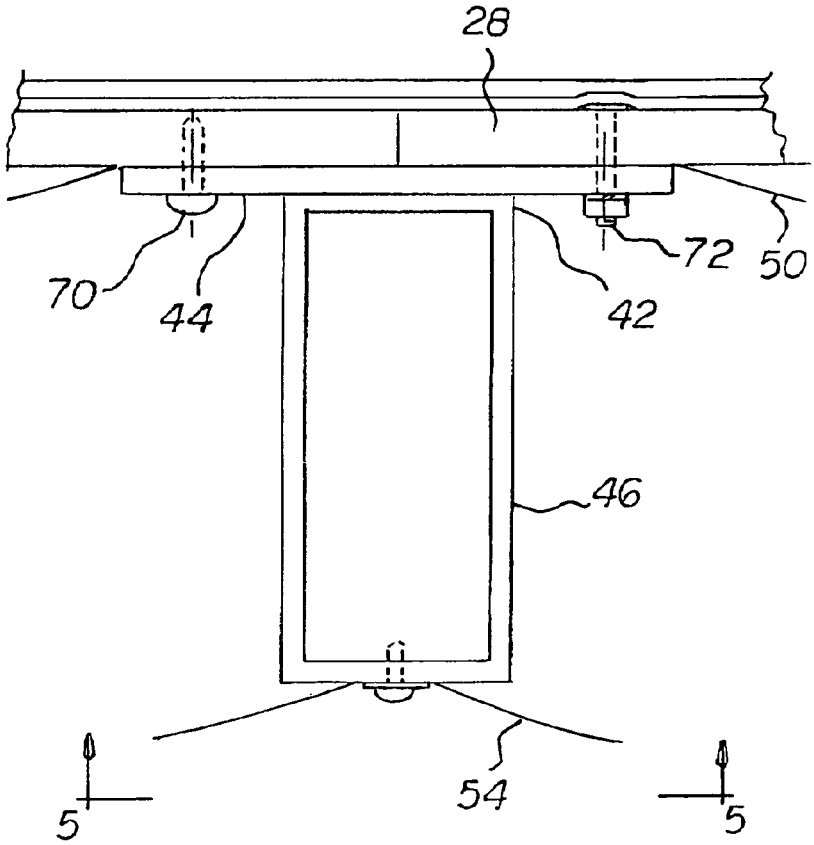
FIG 4

FIG 7
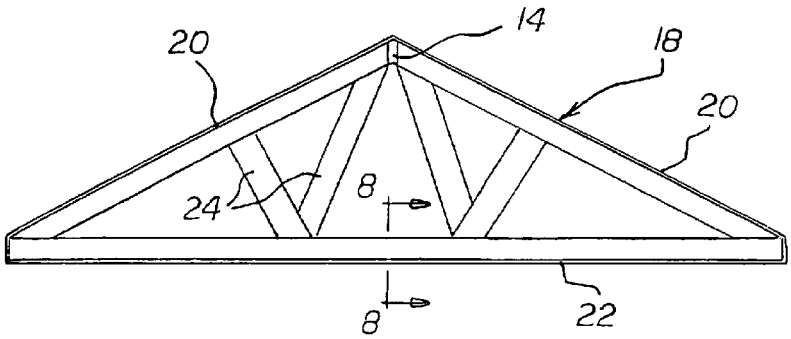
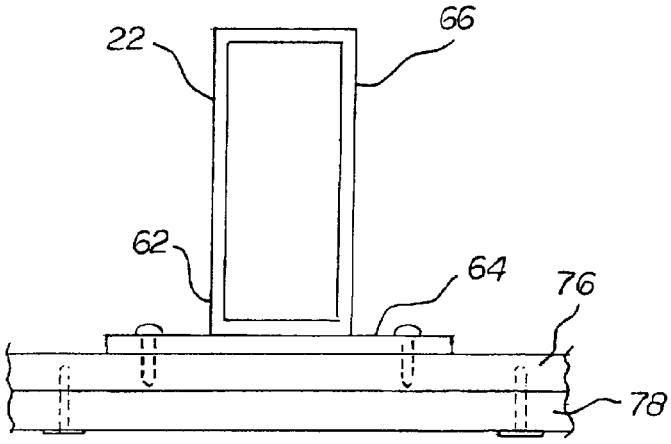
FIG 8

HURRICANE TRUSS ROOF SYSTEM

BACKGROUND OF THE INVENTION

Field of the Invention

The present invention relates to a hurricane truss roof system and more particularly pertains to preserving a building during a high wind/fire event, the preserving being done in a safe, reliable, convenient and economical manner.

SUMMARY OF THE INVENTION

In view of the foregoing disadvantages inherent in the known types of roof systems of known designs and configurations now present in the prior art, the present invention provides an improved hurricane truss roof system. As such, the general purpose of the present invention, which will be described subsequently in greater detail, is to provide a new and improved hurricane truss roof system and method which has all the advantages of the prior art and none of the disadvantages.

To attain this, the present invention essentially comprises a hurricane truss roof system. First provided is a centrally positioned, horizontally disposed ridge board. The ridge board has an upper surface. The ridge board has a lower surface. The ridge board also has side surfaces. The ridge board further has opposed ends.

A plurality of vertically disposed trusses is provided. Each truss has a pair of angled rafters. The rafters are coupled to the ridge board. Each rafter is formed with an upper surface. Each rafter is formed with a lower surface. Each rafter is also formed with side surfaces. Each rafter is further formed with top and bottom ends. Each truss has a horizontal joist. The joist is located beneath and transverse to the ridge board. The joist is formed with an upper surface. The joist is formed with a lower surface. The joist is also formed with side surfaces. The joist is further formed with opposed ends. The ends of the joists are connected to the bottom ends of the rafters. Angled connectors are provided. The connectors connect each joist to associated rafters.

Plywood is provided next. The plywood is supported on the upper edges of the rafters. An underlayment is provided. The underlayment is supported on the plywood. Shingles are provided. The shingles are supported on the underlayment.

Vertically disposed building walls are provided. The walls are provided in a rectilinear configuration. The walls have top edges. The top edges support the lower surfaces of the joists.

Upper TboxTrusses are provided. The upper TboxTrusses are fabricated of galvanized steel. The upper TboxTrusses function as the rafters. Each upper TboxTruss has a planar plate. The planar plate has an upper face. The upper face is attached to and extends downwardly from the plywood. Each planar plate has a downwardly facing lower face. Each upper TboxTruss has a hollow box. The hollow box depends downwardly from the lower face of an associated planar plate.

An interior sheet of a fire resistant fabric Sandel™ sheet material is provided. Sansel is an expired registered trademark of Firesafe Products Corp. Of New York, N.Y. The interior sheet is secured between the upper surfaces of the upper TboxTrusses and the plywood. The interior sheet has interior sags between adjacent TboxTrusses.

An exterior sheet of the fire resistant fabric Sandel™ sheet material is provided. The exterior sheet is secured to the lower surfaces of adjacent upper TboxTrusses. The exterior sheet has exterior sags between adjacent TboxTrusses. The exterior sags are greater than the interior sags.

Provided next is thermal insulation material. The thermal insulation material is located between the interior and exterior sheets. The thermal insulation material is bounded by adjacent hollow boxes. The sheets and thermal insulation material are adapted to abate ill effects of fire.

Further provided are lower TboxTrusses. The lower TboxTrusses are fabricated of galvanized steel. The lower TboxTrusses are coupled to the joists. Each lower TboxTruss has a planar plate. A lower face is attached to an upper edge of a building wall. Each planar plate has an upwardly facing upper face. Each lower TboxTruss has a hollow box. The hollow box extends upwardly from the upper face of an associated planar plate. The planar plate of each rafter is formed as a continuous member with the planar plate of an associated one of the joists.

Provided next is a plurality of threaded fasteners. The threaded fasteners includes rows of screws. The threaded fasteners include a lesser number of flat head bolts. The screws secure each of the planar plates to the rafters and the joists. The rows are provided on opposite sides of the hollow boxes.

Lastly provided are a construction board beneath the joints and a dry wall ceiling beneath the construction board. Fasteners couple the joints to the construction board from above and couple the dry wall ceiling to the construction board from below.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hurricane truss roof system which has all of the advantages of the prior art roof systems of known designs and configurations and none of the disadvantages.

It is another object of the present invention to provide a new and improved roof system which may be easily and efficiently manufactured and marketed.

It is further object of the present invention to provide a new and improved roof system which is of durable and reliable constructions.

An even further object of the present invention is to provide a new and improved roof system which is susceptible of a low cost of manufacture with regard to both materials and labor, and which accordingly is then susceptible of low prices of sale to the consuming public, thereby making such roof system economically available to the buying public.

Even still another object of the present invention is to provide a hurricane truss roof system for preserving a building during a high wind/fire event, the preserving being done in a safe, reliable, convenient and economical manner.

Lastly, it is an object of the present invention to provide a new and improved roof system. A ridge board is provided. A plurality of vertically disposed trusses is also provided. Each truss has angled rafters and a joist. Upper TboxTrusses function as the rafters. Each upper TboxTruss has a planar plate. The planar plate has a hollow box. The hollow box depends downwardly there from. An interior sheet of a fire resistant fabric sheet material is provided above the upper TboxTrusses. An exterior sheet of the fire resistant fabric sheet material is provided below the upper TboxTrusses. Insulation material is located between the interior and exterior sheets and bounded by adjacent hollow boxes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a building having a hurricane truss roof system constructed in accordance with the principles of the present invention.

FIG. 2 is a plan view of the system with parts broken away to show internal constructions, the view being taken along line 2-2 of FIG. 1.

FIG. 3 is a cross sectional view of the system taken along line 3-3 of FIG. 2.

FIG. 4 is an enlarged view of the system taken at Circle 4 of FIG. 3.

FIG. 7 is a cross sectional view of the system taken along line 7-7 of FIG. 1.

FIG. 8 is a cross sectional view of the system taken along line 8-8 of FIG. 7.

The same reference numerals refer to the same parts throughout the various Figures.

DESCRIPTION OF THE PREFERRED EMBODIMENT

Figure 5:
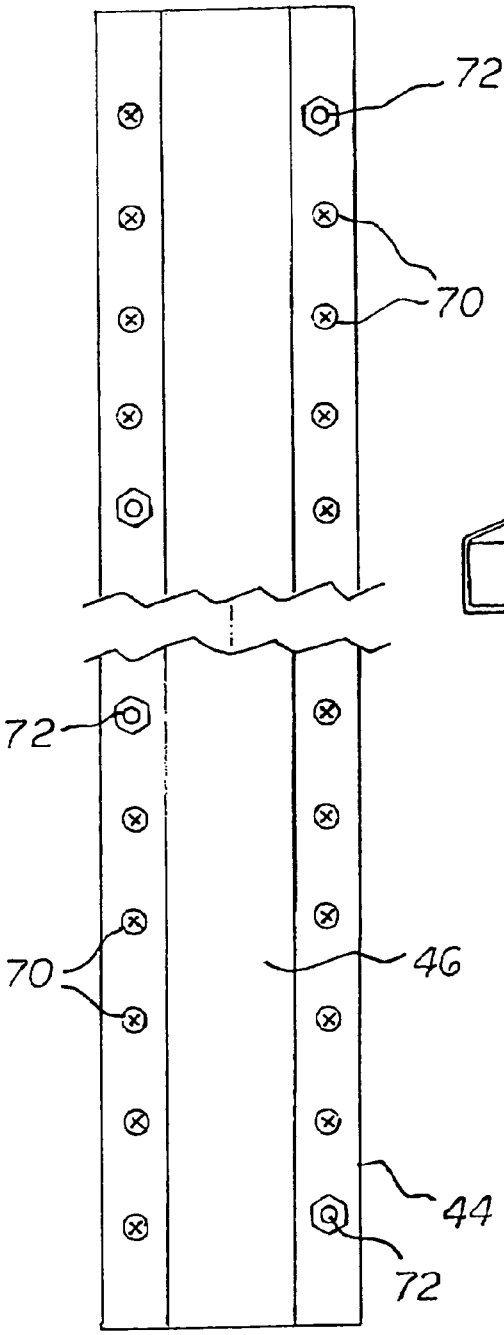
FIG. 5 is a bottom view of the system taken along line 5-5 of FIG. 4.
Figure 6:
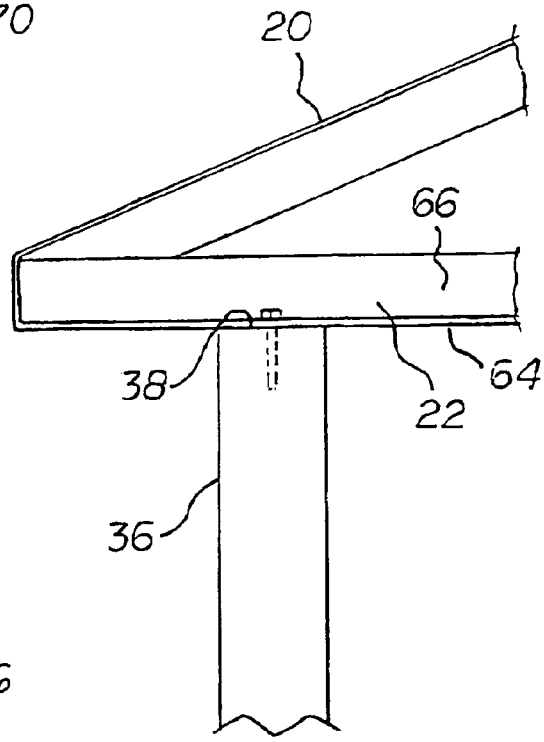
FIG. 6 is a cross sectional view of the system taken along line 6-6 of FIG. 1.

With reference now to the drawings, and in particular to FIG. 1 thereof, the preferred embodiment of the new and improved roof system embodying the principles and concepts of the present invention and generally designated by the reference numeral 10 will be described.

The present invention, the roof system 10 is comprised of a plurality of components. Such components in their broadest context include a ridge board, a plurality of vertically disposed trusses, upper TboxTrusses, an interior sheet, an exterior sheet, and insulation material. Such components are individually configured and correlated with respect to each other so as to attain the desired objective.

First provided is a centrally positioned, horizontally disposed ridge board 14. The ridge board has an upper surface. The ridge board has a lower surface. The ridge board also has side surfaces. The ridge board further has opposed ends.

A plurality of vertically disposed trusses 18 is provided. Each truss has a pair of angled rafters 20. The rafters are coupled to the ridge board. Each rafter is formed with an upper surface. Each rafter is formed with a lower surface. Each rafter is also formed with side surfaces. Each rafter is further formed with top and bottom ends. Each truss has a horizontal joist 22. The joist is located beneath and transverse to the ridge board. The joist is formed with an upper surface. The joist is formed with a lower surface. The joist is also formed with side surfaces. The joist is further formed with opposed ends. The ends of the joists are connected to the bottom ends of the rafters. Angled connectors 24 are provided. The connectors connect each joist to associated rafters.

Plywood 28 is provided next. The plywood is supported on the upper edges of the rafters. An underlayment 30 is provided. The underlayment is supported on the plywood. Shingles 32 are provided. The shingles are supported on the underlayment.

Vertically disposed building walls 36 are provided. The walls are provided in a rectilinear configuration. The walls have top edges 38. The top edges support the lower surfaces of the joists.

Upper TboxTrusses 42 are provided. The upper TboxTrusses are fabricated of galvanized steel. The upper TboxTrusses function as the rafters. Each upper TboxTruss has a planar plate 44. The planar plate has an upper face. The upper face is attached to and extends downwardly from the plywood. Each planar plate has a downwardly facing lower face. Each upper TboxTruss has a hollow box 46. The hollow box depends downwardly from the lower face of an associated planar plate.

An interior sheet 50 of a fire resistant fabric Sandel™ sheet material is provided. Sansel is an expired registered trademark of Firesafe Products Corp. Of New York, N.Y. The interior sheet is secured between the upper surfaces of the upper TboxTrusses and the plywood. The interior sheet has interior sags between adjacent TboxTrusses.

An exterior sheet 54 of the fire resistant fabric Sandel™ sheet material is provided. The exterior sheet is secured to the lower surfaces of adjacent upper TboxTrusses. The exterior sheet has exterior sags between adjacent TboxTrusses. The exterior sags are greater than the interior sags.

Provided next is thermal insulation material 58. The thermal insulation material is located between the interior and exterior sheets. The thermal insulation material is bounded by adjacent hollow boxes. The sheets and thermal insulation material are adapted to abate ill effects of fire.

Further provided are lower TboxTrusses 62. The lower TboxTrusses are fabricated of galvanized steel. The lower TboxTrusses are coupled to the joists. Each lower TboxTruss has a planar plate 64. A lower face is attached to an upper edge of a building wall. Each planar plate has an upwardly facing upper face. Each lower TboxTruss has a hollow box 66. The hollow box extends upwardly from the upper face of an associated planar plate. The planar plate of each rafter is formed as a continuous member with the planar plate of an associated one of the joists.

Provided next is a plurality of threaded fasteners 70, 72. The threaded fasteners includes rows of screws 70. The threaded fasteners include a lesser number of flat head bolts 72. The screws secure each of the planar plates to the rafters and the joists. The rows are provided on opposite sides of the hollow boxes.

Lastly provided are a construction board 76 beneath the joints and a dry wall ceiling 78 beneath the construction board. Fasteners couple the joints to the construction board from above and couple the dry wall ceiling to the construction board from below.

The present invention provides the best hurricane truss, roof and ceiling systems so that homeowners can preserve their home during high wind events. For too many years, homeowners have had to leave their homes, belongings and pets to the elements because of a hurricane. The TboxTuss of the present invention changes the way homes re built to make them safer and longer lasting for generations to come.

The TboxTruss of the present invention differs from other steel trusses or rafters. The TboxTruss is a welded one piece heavy duty galvanized hurricane truss/rafter that has an extra large area for multiple fastenings for truss-to-roof decking attachment. The invention uses through bolting from the outside in and self tapping screws from the inside out. It uses four bolts and eight screws per one running foot. The TboxTruss is designed to grip and hold on to the roof decking in high wind loads in multiple ways. Unlike light gauge steel, the TboxTruss of the present invention is far stronger and self supporting in high wind loads and is far more capable of taking a tree fall strike to protect the occupants of the home. The TboxTruss of the present invention is double anchor bolted to the concrete support walls. The TboxTruss of the present invention is similar only in appearance to a traditional wood frame rafters, but is far stronger and non-industrial in appearance. The TboxTruss presents an attractive appearance. Unlike a two-piece heavy box girder with light gauge steel interface to attach roof decking, the TboxTruss of the present invention is a welded one-piece heavy duty construction. The prior art two-piece type system leaves the light duty steel to take the entire roof deck wind load on its own. Unlike other steel trusses, in the present invention the roof decking, fascia, soffit and ceiling are all attached to a one piece TboxTruss. The TboxTruss of the present invention can accommodate any metal, wood deck or tile roofing.

The TboxTruss of the present invention differs from traditional wood frame rafters. The TboxTruss has superior overall and impact strength. Unlike wood rafters, the TboxTruss can incorporate multiple bolt and screw fasteners without weakening. To add more nails or screws to a wood rafter is to weaken it. When adding additional larger or longer nails to a wood 2×4 or 2×6 rafter, the rafter tends to split, therefore, weakening it—just like splitting logs for firewood. The TboxTruss of the present invention will not burn. It is 100 percent non-combustible and will not contribute to the spread of a fire. The TboxTruss of the present invention will not rot, warp, split or crack and it is termite proof. The TboxTruss is built to last generations, not just years. Steel is "Green" and is 100 percent recyclable. The TboxTruss can incorporate more design flexibility because of its one-piece construction and multiple attachment interfacing. The TboxTruss is not susceptible to mold or moisture buildup. The TboxTruss of the present invention provides far more resistance to hurricanes and tornados than traditional wood frame rafters. The TboxTruss is a hybrid system that only incorporates the best of all materials to provide the best possible truss, roof, fascia, soffit and ceiling systems. The TboxTruss provides rigid structural integrity and is extremely resistant to uplift should windows and door fail. The TboxTruss of the present invention incorporates a double Sandel Fire Barrier Fabric with fiberglass insulation for superior fire resistance when using plywood roof decking.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roof system comprising:

a ridge board;

a plurality of vertically disposed trusses, each truss having angled rafters and a joist;

upper TboxTrusses functioning as the rafters, each upper TboxTruss having a planar plate with a hollow box depending downwardly there from, each upper TboxTruss being fabricated of metal with the box having a rectangular cross sectional configuration;

an interior sheet of a fire resistant fabric sheet material above the upper TboxTrusses;

an exterior sheet of the fire resistant fabric sheet material below the upper TboxTrusses;

insulation material located between the interior and exterior sheets and bounded by adjacent hollow boxes;

lower TboxTrusses functioning as joists, each lower TboxTruss having a planar plate with a lower face and an upwardly facing upper face, each lower TboxTruss having a hollow box extending upwardly from the upper face of an associated planar plate, each lower TboxTruss being fabricated of metal with the box having a rectangular cross sectional configuration, each of the trusses including the upper and lower TboxTrusses being of a welded one-piece construction.

2. The system as set forth in claim 1 and further including:

a plurality of threaded fasteners including rows of screws and bolts securing each planar plate to a support surface, the rows being on opposite sides of the boxes.

3. The system as set forth in claim 1 wherein the TboxTrusses are fabricated of galvanized steel.

4. A hurricane truss roof system (10) for preserving a building during a high wind/fire event, the system comprising, in combination:

a centrally positioned, horizontally disposed ridge board (14) having an upper surface and a lower surface and side surfaces and opposed ends;

a plurality of vertically disposed trusses (18), each truss having a pair of angled rafters (20) coupled to the ridge board, each of the rafters being hollow with a rectangular cross sectional configuration, each rafter formed with an upper surface and a lower surface and side surfaces and top and bottom ends, each truss having a horizontal joist (22) located beneath and transverse to the ridge board and formed with an upper surface and a lower surface and side surfaces and opposed ends, each of the joists being hollow with a rectangular cross sectional configuration, the ends of the joists connected to the bottom ends of the rafters, angled connectors (24) connecting each joist to associated rafters;

plywood (28) supported on the upper edges of the rafters, an underlayment (30) supported on the plywood, shingles (32) supported on the underlayment;

vertically disposed building walls (36) in a rectilinear configuration with top edges (38) supporting the lower surfaces of the joists;

upper TboxTrusses (42) fabricated of galvanized steel and functioning as the rafters, each upper TboxTruss having a planar plate (44) with an upper face attached to and extending downwardly from the plywood, each planar plate having a downwardly facing lower face, each upper TboxTruss having a hollow box (46) depending downwardly from the lower face of an associated planar plate;

an interior sheet (50) of a fire resistant fabric sheet material secured between the upper surfaces of the upper TboxTrusses and the plywood, the interior sheet having interior sags between adjacent TboxTrusses;

an exterior sheet (54) of the fire resistant fabric sheet material secured to the lower surfaces of adjacent upper TboxTrusses, the exterior sheet having exterior sags between adjacent TboxTrusses, the exterior sags being greater than the interior sags;

thermal insulation material (58) located between the interior and exterior sheets and bounded by adjacent hollow boxes, the sheets and thermal insulation material adapted to abate ill effects of fire;

lower TboxTrusses (62) fabricated of galvanized steel and coupled to the joists, each lower TboxTruss having a planar plate (64) with a lower face attached to an upper edge of a building wall, each planar plate having an upwardly facing upper face, each lower TboxTruss having a hollow box (66) extending upwardly from the upper face of an associated planar plate, the planar plate of each rafter being formed as a continuous member with the planar plate of an associated one of the joists, each of the trusses including the upper and lower TboxTrusses being of a welded one-piece construction;

a plurality of threaded fasteners (70), (72) including rows of screws (70) and a lesser number of flat head bolts (72) securing each of the planar plates to the rafters and the joists, the rows being on opposite sides of the hollow boxes; and a construction board (76) beneath the joists and a dry wall ceiling (78) beneath the construction board and fasteners coupling the joists to the construction board from above and coupling the dry wall ceiling to the construction board from below.

* * * * *